United States Patent [19]

Kronshagen

[11] Patent Number: 5,056,170

[45] Date of Patent: Oct. 15, 1991

[54] LIFTING DEVICE, PARTICULARLY FOR BEDS

[76] Inventor: Manfred Kronshagen, Poststrasse 212, CH-8957 Spreitenbach, Switzerland

[21] Appl. No.: 685,606

[22] Filed: Apr. 15, 1991

[30] Foreign Application Priority Data

Apr. 18, 1990 [CH] Switzerland ..... 1310/90

[51] Int. Cl.[5] ..... A47C 19/04; B66F 7/14

[52] U.S. Cl. ..... 5/10.1; 5/11; 254/92

[58] Field of Search ..... 5/9.1, 10.1, 10.2, 11, 5/158; 254/89 R, 92

[56] References Cited

U.S. PATENT DOCUMENTS

| | | | |
|---|---|---|---|
| 1,170,929 | 2/1916 | Nylander | 254/89 R |
| 1,497,046 | 6/1924 | Trusler . | |
| 2,655,223 | 10/1953 | Villars | 245/89 |
| 3,028,606 | 4/1962 | Boutet | 5/10.1 X |
| 3,512,314 | 5/1970 | George et al. | 5/10.1 X |
| 3,722,627 | 3/1973 | Fricke | 254/92 |
| 4,837,877 | 6/1989 | Hamada et al. | 5/10.2 |

FOREIGN PATENT DOCUMENTS 2584283 1/1987 France .

*Primary Examiner*—Michael F. Trettel

[57] ABSTRACT

The lifting device comprises essentially a flat, rigid frame suitable for wall fixing, formed by two longitudinally slotted vertical guide posts connected together at top and bottom by cross-struts. Within each guide post a screw-shaft spindle is set on bearings, and the two spindles can be driven in the same sense of rotation by a common motor. Two nuts placed above each other a certain distance apart run on each screw-shaft spindle and are guided along the slot in their respective post. A cantilever is attached to the pair of nuts in each guide post and projects from the plane of the frame. When a bed or other load is in a raised position, the space below it is left completely free and is freely accessible.

8 Claims, 3 Drawing Sheets

LIFTING DEVICE, PARTICULARLY FOR BEDS

BACKGROUND OF THE INVENTION

The invention relates to a lifting device, particularly for beds, having two vertical guide posts, each formed as a hollow profile having a longitudinal slot and provided with a screw-shaft spindle rotatably mounted within the hollow profile. Drive means are provided for jointly rotating said spindles, and a load-carrying element associated with each guide post, each connected across said respective longitudinal slot to a spindle nut means riding on said respective spindle, the two load-carrying elements thereby being adapted to be jointly raised and lowered.

PRIOR ART

In the past, various devices have been proposed for raising to the ceiling a bed that is not in use, in order to provide more floor space. Some of these proposals have included provisions for special and complex drive mechanisms built into the bed frame; another known device has four corner posts, each with a screw-shaft spindle driven by bevel gears. Particularly because they need free-standing posts supported on the floor of the room, the practical applicability and usefulness of these devices is extremely doubtful. A lifting device of the type referred to above, but for raising and lowering vehicles in automobile workshops, is described in U.S. Pat. No. 1,497,046. This provides for two free-standing posts, each separately supported on the floor. Their two screw-shaft spindles can be driven jointly by a hand crank via bevel gears and an intermediate shaft. This arrangement requires a right-hand thread on the spindle in one post and a left-hand thread on that in the other, with correspondingly threaded nuts. Two vehicle brackets, one each connected to one of the spindle nuts, are fitted between the two posts. Such a device is totally unsuitable for raising and lowering beds or similar loads.

BRIEF SUMMARY OF THE INVENTION

It is an object of the present invention to provide for a lifting device that avoids the shortcomings of the known arrangements referred to, that in particular is easy to install and leaves practically the whole of the space below the raised bed free for other purposes.

The present invention meets these requirements by a lifting device that has its two guide posts connected at the top and bottom by cross-struts to form a flat, rigid frame suitable for wall fixing, and wherein on each screw-shaft spindle rides a pair of spindle nuts arranged above each other a distance apart, a cantilever being attached to each pair of spindle nuts and projecting beyond the plane of said frame.

Hence, the lifting device is so designed that the frame stands on the floor and is attached flat to the wall of the room; a bed, with its long side parallel to the wall, is carried on the two cantilevers, thus leaving the bed completely free on its three other sides. Under the bed there are only the two cantilevers which are raised together with the bed. Instead of a bed, the lifting device according to the present invention can also be used for raising other loads out of the way, for example large toy installations such as model-railway layouts. It is also suitable for industrial applications, such as adjustable-height worktops for assembly work etc.

A prefered embodiment of the lifting device according to the invention is described in detail below in conjunction with the drawings.

DETAILED DESCRIPTION OF THE INVENTION

Figure 2:
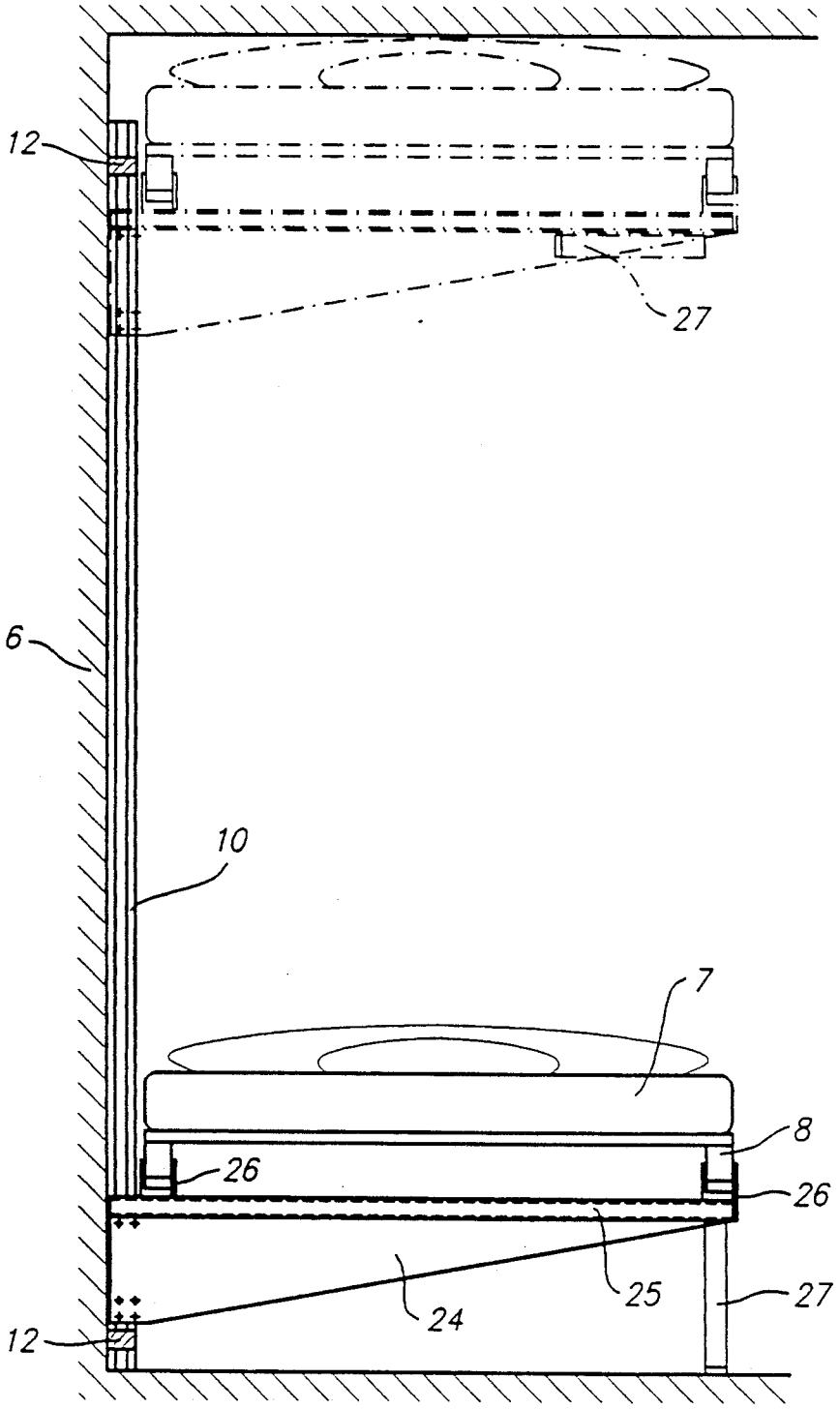
FIG. 2 is a vertical section on line II—II in FIG. 1 which shows the lifting device secured to a wall in a room, with a bed placed on the cantilevers; dot-dash lines show the bed and cantilevers in the fully raised position against the ceiling.
Figure 3:
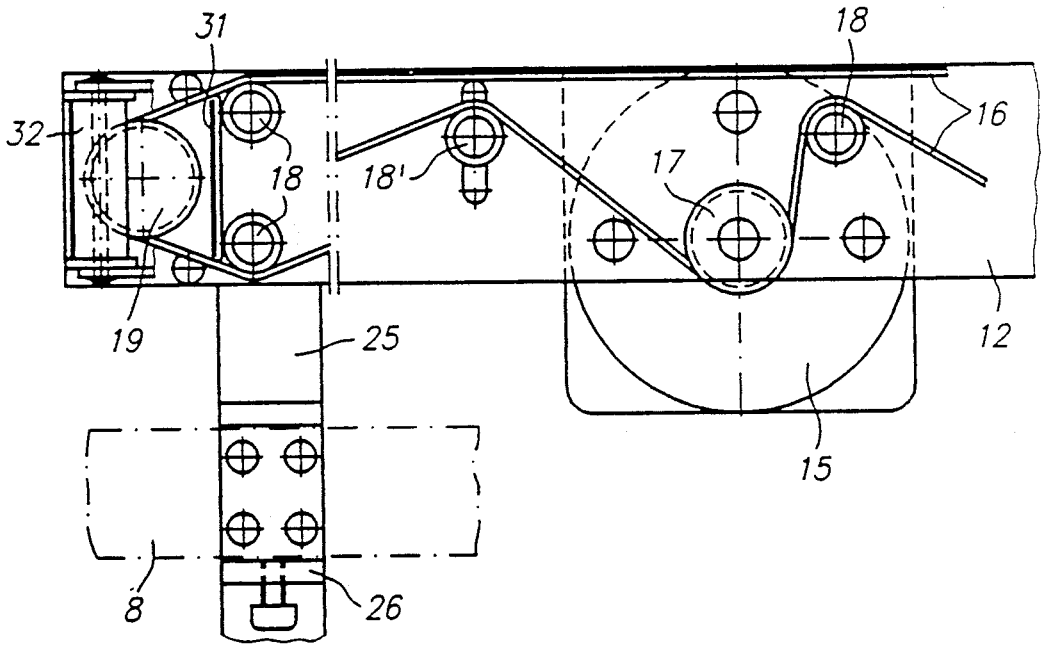
FIG. 3 is a larger-scale plan view looking down on the top left-hand corner of the lifting device in FIG. 1.
Figure 4:
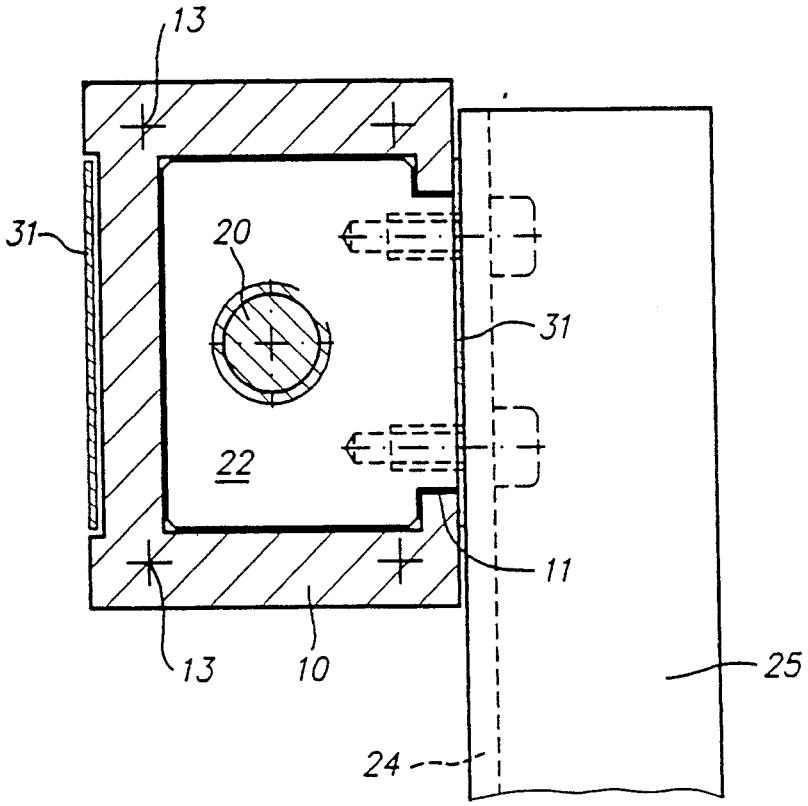
FIG. 4 is a horizontal section along line IV—IV in FIG. 1 through the left-hand guide post.

The load-bearing construction of the lifting device as shown comprises a flat, rigid frame which consists of two vertical guide postst 10 connected by two cross-struts 12, one each at top and bottom; the centerlines 13 of the connecting screws for the cross-struts 12 are indicated in the horizontal cross-section of the post 10 shown in FIG. 4. Fixing lugs or brakkets 14 are attached to the two cross-struts 12 and/or the guide posts 10. As shown in FIG. 2, the lifting device, with the guide posts of said flat, rigid frame set on the floor, may be readily secured to a wall 6 by means of these fixing lugs or brackets. Preferably, each guide post 10 is made of an extrusion-moulded light alloy that requires no machining or refinishing, and forms a hollow four-sided section which has a continuous longitudinal slot 11. Each of the two guide posts 10 has a rotatable screw-shaft spindle 20 which runs parallel with the post inside the hollow profile in bearings 21 mounted in the upper and lower cross-struts 12. On each screw-shaft spindle 20, two spindle nuts 22 are placed above each other a certain distance apart and are guided along the corresponding guide post 10, in this case against the inner walls of the hollow foursided profile. The nuts 22 should preferably be of an abrasion-resistant synthetic material; due to its favourable abrasion and gliding properties relative to the aluminum alloy of the guide post 10 and to a screw-shaft spindle 20 with a rolled thread, a low-pressure polyethylene mixture (such as a product marketed under the trade name POLYDUR) is particularly suitable as a material for the spindle nuts.

As shown in FIG. 4, when the two guide posts 10 are viewed in the plane of the frame, their longitudinal slots 11 face each other and the nuts 22 project through the slot slightly beyond the profile 10. A cantilever 24 for carrying the load is associated with each guide post and is attached to the pair of nuts 22 placed above each other on each spindle so that each of the two cantilevers 24 project from the plane of the frame.

Figure 1:
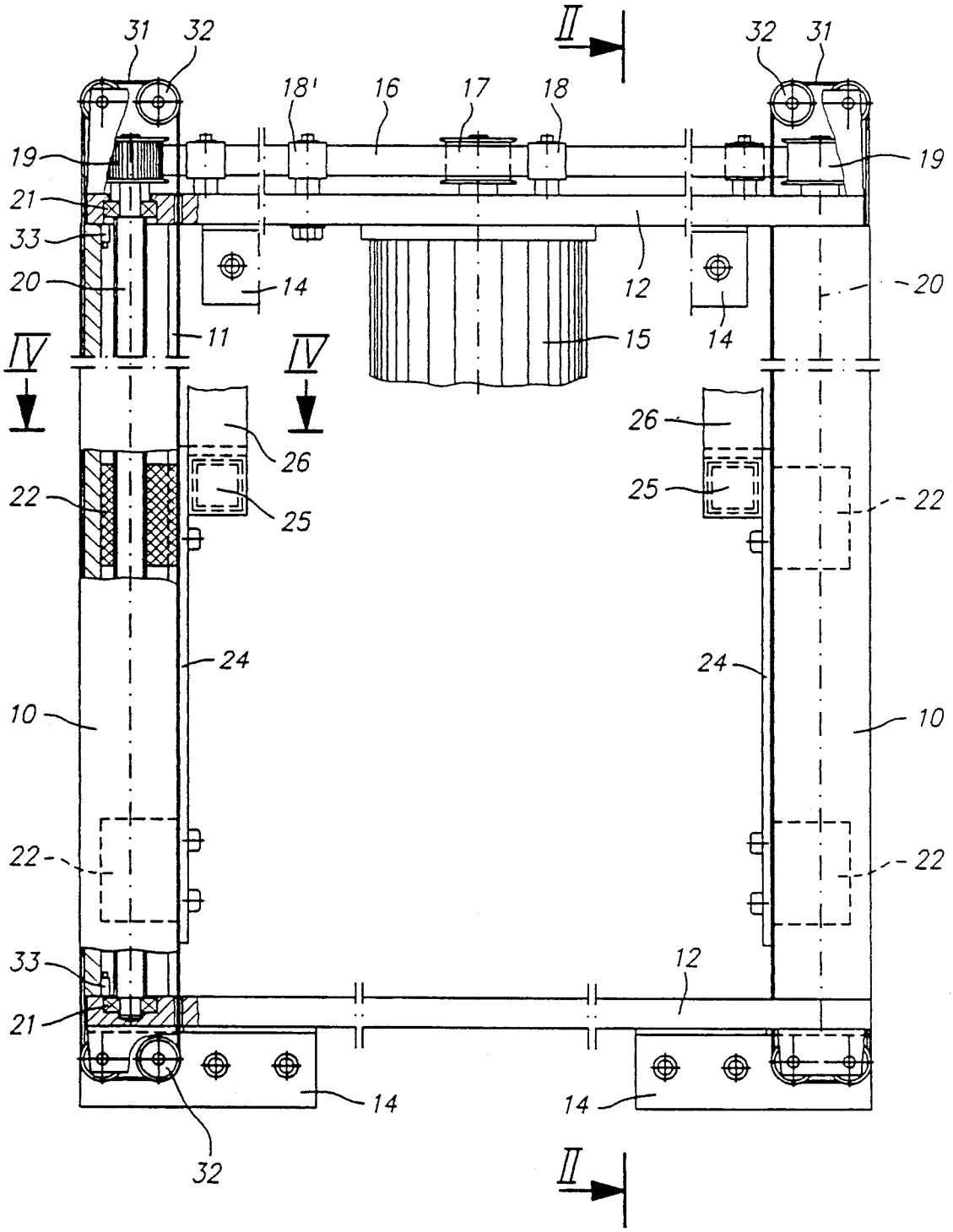
FIG. 1 is an elevation of the complete lifting device, in which the left-hand guide post is partly shown in section and all four sides of the frame are shown shortened.

In the present embodiment, each cantilever 24 is made as a mainly flat panel or plate 24 and has a four-sided tubular profile 25 permanently fixed to its upper edge. The two screw-shaft spindles 20 are driven synchronously to raise and lower both cantilevers 24 evenly together along their respective guide posts; FIG. 1 shows the two cantilevers near their bottom position. FIG. 2 shows a holding organ 26 on the top edge of each cantilever for attaching the frame 8 of a bed 7. If desired, the holding organs 26 may be arranged slidably on the cantilevers to suit bed frames 8 of various widths. At the free end of each cantilever 24, a supporting leg 27 may be fitted (not shown in FIG. 1) that can be hinged up horizontally against the four-sided hollow profile 25 when the cantilever is raised.

To drive the two screw-shaft spindles 20 synchronously, a common drive motor 15 is used, which may for example be attached to the upper cross-strut 12. An endless toothed belt 16 provides the driving link from the pinion 17 of the motor to two pinions 19, one of which is provided at the top of each spindle 20; the toothed belt 16 runs over the pinions 17 and 19, idler pulleys 18, and a tensioning pulley 18'. This type of drive system, driving both spindles in the same sense of rotation, allows the use of identical, right-hand threaded spindles and nuts in the two guide posts.

End switches 33 are fitted to the guide posts 10 and cooperate with the nuts 22 to define the upper and lower end positions of the cantilevers.

A cover strip for covering the longitudinal slot 11 on each guide post is attached to each cantilever; this is made of a tape 31 formed into a loop and guided over upper and lower deflection rollers 32 and running with the cantilevers as they are being raised and lowered. The cover strips protect the spindles 20 and the inner gliding surfaces of the guide posts 10 against dirt and accidental access.

The lifting device described may be easily transported as a one-piece assembly, except for the two cantilevers which preferably should be kept apart from the nuts 22 during transportation. The flat frame can be readily fixed to a wall of a room and then the two cantilevers are fitted. When finally the drive motor 15 is connected, the lifting device is complete and ready for use. To prevent the cantilevers being raised and lowered accidentally or by unauthorized persons such as children, it is desirable to provide a motor switch that requires a key or the input of a code number to operate, or similar; a remote-control system operated by an infra-red beam or similar is also suitable.

The embodiment as shown, with a pair of nuts 22 guided along the posts 10, provides a very effective means of load transmission and guidance of the loaded cantilevers along the guide posts. Moreover, the pair of nuts on each screw-shaft spindle can be spaced at a certain vertical distance apart which may be varied as necessary for fixing cantilever plates of different heights. The lifting device can be used with standard commercially available beds without requiring modification of the bed frames and without further assembly work. The two cantilevers carry the bed with its long sides parallel with the wall or frame and leave the other three sides completely free. As shown in FIG. 2, a particular advantage of this invention is that when the bed is raised, the space below it remains completely free, accessible, and usable, except for the samll amount of space required by the flat frame attached to the wall. Further, as the load is supported on a pair of self-braking nuts that run on each of the spindles, this invention provides a high degree of safety, by contrast, for example, to loads supported by ropes, chains and such like. To hide the frame and disguise the device in living accomodation, for example, the whole of the frame may be hidden behind a storage wall or the like (not shown) in which only two narrow vertical slots have to be provided to allow the passage of the two plate-shaped cantilevers.

I claim:

1. A lifting device, particularly for beds, having two vertical guide posts, each formed as a hollow profile having a longitudinal slot and provided with a screw shaft spindle rotatably mounted within the hollow profile, drive means for jointly rotating said spindles, a load-carrying element associated with each guide post, each connected across said respective longitudinal slot to a spindle nut means riding on said respective spindle, the two load-carrying elements thereby being adapted to be jointly raised and lowered, wherein said two guide posts are connected to each other by an upper and a lower cross-strut to form a flat, rigid frame suitable for wall fixing, and wherein on each screw-shaft spindle rides a pair of spindle nuts arranged above each other a distance apart, a cantilever being attached to each pair of spindle nuts and projecting from the plane of said frame.

2. A lifting device in accordance with claim 1, wherein the guide posts are made of an extrusion-moulded light-alloy section and the spindle nuts are made of an abrasion-resistant synthetic material.

3. A lifting device in accordance with claim 1, wherein said cantilevers are designed as virtually flat panels or plates and said longitudinal slots of the two guide posts face each other in the plane of said frame.

4. A lifting device in accordance with claim 1, wherein a supporting foot adapted to be folded or hinged up is attached to the free end of each cantilever.

5. A lifting device in accordance with claim 1, wherein each cantilever has at least one holding organ for a bed frame.

6. A lifting device in accordance with claim 1, wherein a cover element is attached to and moves with each cantilever to close the longitudinal slot of its respective guide post.

7. A lifting device in accordance with claim 1, having a common drive motor with a motor pinion, attached to one of the cross-struts, wherein said spindles are adapted to be driven in the same sense of rotation via a toothed endless belt linking said motor pinion with pinions mounted on each of said screw-shaft spindles.

8. A lifting device in accordance with claim 1, having end switches to define upper and lower end positions of said cantilevers.

* * * * *